US005944220A

United States Patent [19]

Garske et al.

[11] Patent Number: 5,944,220

[45] Date of Patent: Aug. 31, 1999

[54] SANITIZED LID DISPENSER

[76] Inventors: Harold B. Garske; Maggie Garske, both of 5923 Hazel Way, Paradise, Calif. 95969

[21] Appl. No.: 08/946,559

[22] Filed: Oct. 7, 1997

[51] Int. Cl.[6] ..... B65G 59/00

[52] U.S. Cl. ..... 221/312 A; 312/45

[58] Field of Search ..... 221/221, 312 A, 221/312 R, 282, 283, 256; 312/45, 42

[56] References Cited

U.S. PATENT DOCUMENTS 2,215,850 9/1940 Holdeman ..... 221/312 A 3,228,555 1/1966 Pinto ..... 221/312 A 5,865,341 2/1999 Martin ..... 221/312 A

*Primary Examiner*—Kenneth W. Noland

[57] ABSTRACT

A lid dispenser for round plastic lids of the type normally used on plastic take-out cups for coffee, soft drinks, and the like in convenience stores is in the form of a sanitized tubular container. The lids are stored inside a protective housing. A cap that snaps down on the top of the housing completely seals off the upper end. The bottom end of the housing is open. The plastic lids hang on a center stainless steel rod passed through the straw openings in the lids. The lids can be retrieved one at a time by grasping a lid through a finger opening and pulling the lid from the opened bottom of the dispenser.

1 Claim, 2 Drawing Sheets

SANITIZED LID DISPENSER

BACKGROUND OF THE INVENTION

This invention relates to lid dispensers for round plastic lids of the type normally used on plastic take-out cups for coffee, soft drinks, and the like in convenience stores. The present invention is particularly directed towards a dispensing device where lids are stored inside a tubular dispenser.

Although several types of tubular dispensers for plastic and paper cups are seen in past-art patents and in the market place, commercial plastic lid dispensers are not readily available in the market place or disclosed in past-art patents.

BRIEF SUMMARY OF THE INVENTION

Therefore, in practicing my invention, I provide a tubular lid dispenser for round plastic lids of the type normally used on plastic take-out cups for coffee, soft drinks, and the like in convenience stores. The lids are stored inside a protective tubular housing. A cap that snaps down on the top of the housing completely seals off the upper end. The bottom end of the housing is open. The plastic lids hang on a center stainless steel rod passed through the straw openings in the lids. A washer slightly larger than the diameter of the center rod is attached at the lower end by a small bolt. Though securely retained, the lids can be snapped off over the washer at the bottom of the housing one-by-one as needed. A small circular weight with a hole in the center can be placed on top of a stack of lids if required. The weight helps move the lids downward as they are being removed by customers. A rounded finger hole open at the bottom in the base of the housing allows lids to be removed one at a time by the customer gripping the edge of the lid with the fingers and snapping it down.

A principal object of the invention is to provide a sanitary holder for round plastic lids that prevents the lids from becoming contaminated by handling.

Another object of the invention is to provide a plastic lid dispenser that can be structured to accept a variety of lid sizes.

A further object of my invention is to provide a sanitized lid dispenser that is easily loaded by unscrewing the cap and loading the lids on a center rod.

A still further object of the present invention is to provide a sanitized lid dispenser from which lids can be retrieved one at a time from the bottom of the dispenser.

Other objects and the many advantages of the present invention will be better understood by reading descriptions of numbered parts in the specification and comparing them with like numbered parts illustrated in the included drawings.

DETAILED DESCRIPTION OF THE INVENTION

Figure 1:
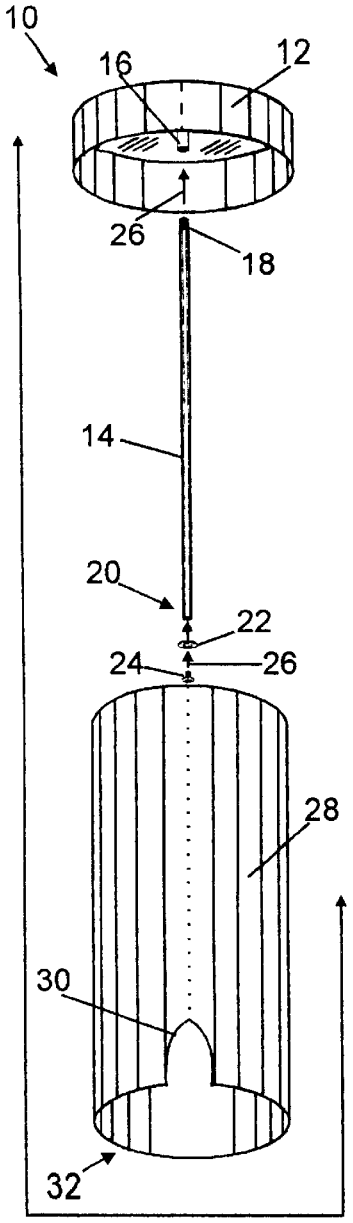
FIG. 1 shows an exploded vertical view of the invention.
Figure 2:
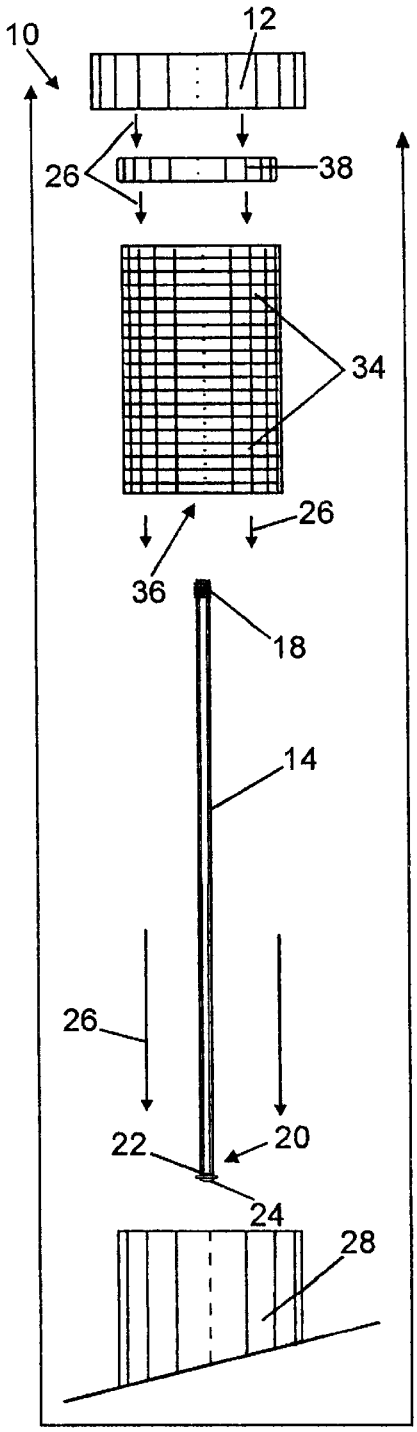
FIG. 2 shows a illustration of how the round plastic lids are loaded onto the center rod of the invention. A small round weight is shown ready for placement on top of the lid stack.

Referring now to the drawings at FIG. 1 where the invention generally is referenced as invention 10. In FIG. 1 invention 10 has cap 12 at the top in the illustration. Affixed to the inside surface of cap 12 is threaded rod receiver 16 just above rod threads 18 at the top of lid retainer rod 14. At the lower end of rod 14 is inside threaded bore 20 just above washer 22 and bolt 26. Rod 14 is designed to pass through lid straw opening 36 in lids 34 (See FIG. 2.). At the lower end of rod 14 in FIG. 1 is tubular housing 28. The bottom of tubular housing 28 is opened 32 and has a curved rectangular finger opening in the side wall 30. In FIG. 2, a side partial drawing of invention 10, cap 12 is upward over a circular weight 38. Weight 38 fits over rod 14 and slides down on top of stacked plastic cup lids 34. Stacked plastic cup lids 34 slide down over rod 14 with rod 14 passed through lid straw holes 36. Directional arrows 26 in FIGS. 1 and 2 show the direction for installing the parts of invention 10. Lid retainer washer 22 is held affixed to the lower end of rod 14 by bolt 24. Lid retainer washer 22 is large enough to prevent lids 34 from sliding off the bottom end of rod 14 but a pull downward on the edge of a lid 34 will pull the straw opening over washer 22 and will release lid 34 for use.

Figure 3:
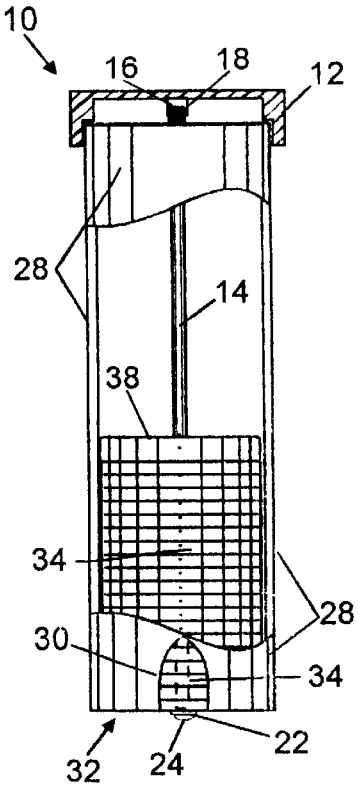
FIG. 3 shows a see-through illustration of the loaded device ready for use. Lids can be pulled downward by a customer grasping the edge of the bottom lid and pulling it downward over the small washer at the bottom of the center rod.
Figure 4:
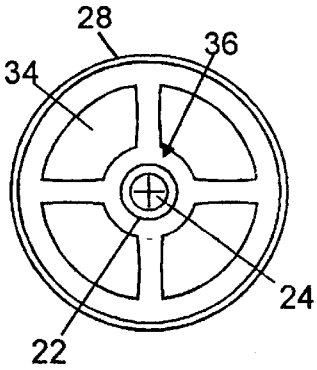
FIG. 4 shows a illustration of a plastic lid with a center straw cross-cut opening in the top. To hold the lids, the center rod is passed through this straw opening. Most lids have this opening or a punch-out center which can also be used in this invention.

FIG. 3 shows invention 10 assembled and sectioned to disclose plastic cup lids 34 installed on rod 14 inside of tubular housing 28. Rod 14 at the top is screwed into threaded rod receiver 16 inside of cap 12. Circular weight 38 rests on top of stacked plastic cup lids 34. Weight 38 pushes downward on stacked plastic lids 34 to keep them moving downward as each lid 34 is removed at the bottom of housing 28 through open bottom 32 by their being pulled at opening 30. FIG. 4 shows tubular housing 28 from a bottom plan view with plastic lids 34 inside. Plastic lids 34 are retained on rod 14 (not seen) by washer 22 held by bold 24.

Figure 5:
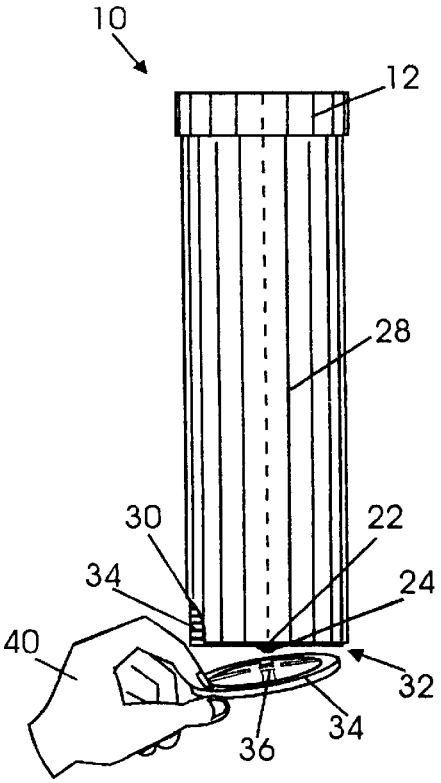
FIG. 5 shows the device of this invention loaded and in use. The fingers of a customer's hand is shown removing a lid from the open lower end of the housing.
Figure 6:
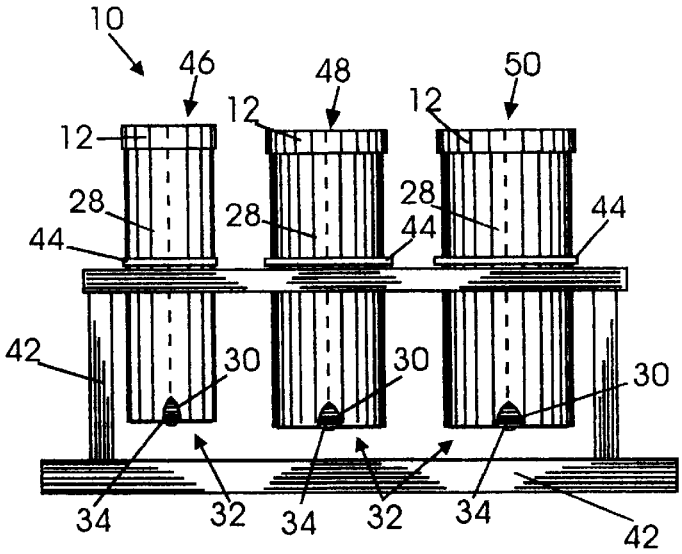
FIG. 6 shows different housing sizes for different sized lids mounted in a stand. The stand could be a wall shelf or a free-standing structure as illustrated. The housings shown have center positioning rings installed to keep them at the right height for use in the stand openings.
Figure 7:
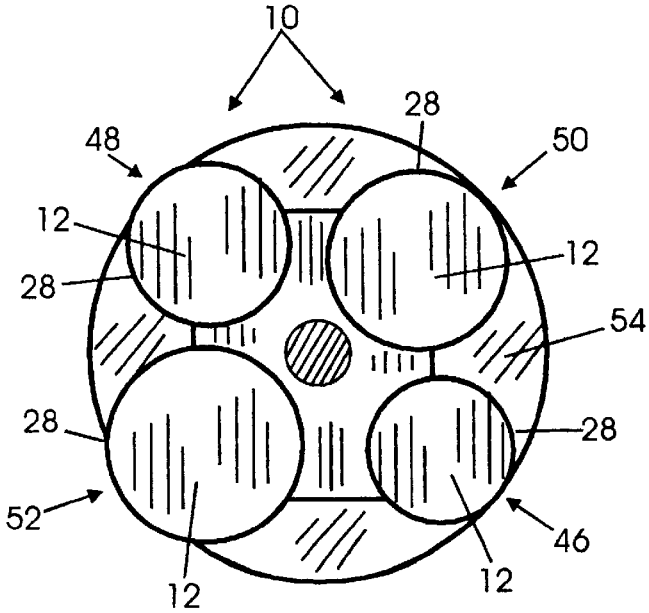
FIG. 7 shows a top plan view of different size embodiments of the present invention mounted on a Lazy Susan. In this view, only the cap tops can be seen.

FIG. 5 illustrates invention 10 assembled and in use. The fingers of hand 40 are pulling out a single lid 34 by grasping an edge through opening 30 and snapping lid 34 out the opened bottom of housing 28. FIG. 6 shown there sizes of invention 10, small 46, medium 48 and large 50 in rack 42. Apertures in the top of rack 42 allow housings 28 to slide down and be held by housing retainers 44. Housing retainers 44 can be adjusted so housings 28 can be adjusted for best use. FIG. 7 is a top plan view of Lazy Susan 54 and illustrates how the different sized housings 28 of invention 10 could fit. Housing 28 for small lids 34 is lower right in the illustration. Medium sized housing 48 is crosswise from small size 34 and large lid size 50 is opposite corner wise from extra large lid size housing 52. Invention 10 is a sanitized lid dispenser for round plastic lids 34 of the type normally used on plastic take-out cups for coffee, soft drinks, and the like.

Although I have described an embodiment according to the invention with considerable details in the foregoing specification and illustrated it extensively in the drawings, it is to be understood that I may make changes in the structure of the device so long as any changes made remain within the scope of the appended claims and any changed devices similar to mine made by others that fall within my claim scope, I shall consider such devices to be my invention.

We claim:

1. A sanitized dispenser in combination for use with plastic lids having a tubular housing, said housing closed off at an upwardly end by a removable top cap, said cap affixed with a detachable rod, said rod sized and arranged inside said tubular housing to fit said plastic lids stacked on said rod with said rod passed through straw openings in said lids, said tubular housing opened at a downwardly terminal end, said lids retrievable through a finger opening in the side of said tubular housing adjacent said opened downwardly tubular end with said lids snapping off over a bolt-held washer affixed at a downwardly terminal end of said rod.

* * * * *